US010273132B2

(12) United States Patent
Sheeley

(10) Patent No.: US 10,273,132 B2
(45) Date of Patent: Apr. 30, 2019

(54) ISOLATED ELECTRONIC BACKBONE ARCHITECTURE FOR AERIAL DEVICES

(71) Applicant: Altec Industries, Inc., Birmingham, AL (US)

(72) Inventor: Tyler G. Sheeley, Saint Joseph, MO (US)

(73) Assignee: Altec Industries, Inc., Birmingham, AL (US)

( * ) Notice: Subject to any disclaimer, the term of this patent is extended or adjusted under 35 U.S.C. 154(b) by 172 days.

(21) Appl. No.: 14/976,235

(22) Filed: Dec. 21, 2015

(65) Prior Publication Data

US 2017/0174488 A1 Jun. 22, 2017

(51) Int. Cl.
*B66F 11/04* (2006.01)
*B66F 17/00* (2006.01)

(52) U.S. Cl.
CPC ..... *B66F 11/046* (2013.01); *B66F 17/006* (2013.01)

(58) Field of Classification Search
CPC ..... B66C 23/88; B66C 15/00; F04B 17/03; B66F 17/006
USPC ..... 180/53.5; 182/2.1–2.3, 2.6–2.8, 2.11, 182/2.4, 46, 141, 148, 149
See application file for complete search history.

(56) References Cited

U.S. PATENT DOCUMENTS 2,841,404 A * 7/1958 Eitel ..... B66F 11/046 182/19
2,896,750 A * 7/1959 Eitel ..... B66F 11/046 182/2.11
3,136,385 A * 6/1964 Eitel ..... B66F 11/046 182/2.11
3,139,948 A * 7/1964 Rorden ..... B66F 11/044 174/5 R
3,320,524 A 5/1967 Miller, Jr. et al.
3,516,514 A 6/1970 Malloy et al.
4,470,229 A * 9/1984 Muse ..... B66C 13/12 414/918
4,553,632 A * 11/1985 Griffiths ..... B66F 11/044 182/19
4,694,122 A 9/1987 Visser
(Continued)

OTHER PUBLICATIONS

Doerry, "Next Generation Integrated Power Systems (NGIPS) for Future Fleet," IEEE Electric Ship Technologies Symposium, Baltimore, MD, found at http://ewh.ieee.org/conf/ests09/ESTS-2009%20Capt%20Doerry.pdf, Apr. 21, 2009.
(Continued)

*Primary Examiner* — Daniel P Cahn
(74) *Attorney, Agent, or Firm* — Erise IP, P.A.

(57) ABSTRACT

An electronic backbone architecture is configured to provide electrical power to an aerial device. The isolated electronic backbone architecture comprises: a power source for generating electrical power, a first actuator, a first electrical motor for powering the first actuator, a second actuator, a second electrical motor for powering the second actuator, and a protected electrical line. The first actuator is disposed adjacent to the first electrical motor. The second actuator is disposed adjacent to the second electrical motor. The protected electrical line is configured to carry electrical current between the power source, the first electrical motor, and the second electrical motor.

8 Claims, 5 Drawing Sheets

(56) References Cited

U.S. PATENT DOCUMENTS

| | | | | |
|---|---|---|---|---|
| 4,762,199 | A * | 8/1988 | Holmes | B66F 11/044 182/148 |
| 4,799,573 | A * | 1/1989 | Simnovec | B66F 11/044 182/2.1 |
| 4,877,422 | A * | 10/1989 | Walbridge | B01D 53/26 182/2.4 |
| 5,268,591 | A * | 12/1993 | Fujimoto | H02G 1/02 182/2.11 |
| 5,293,001 | A | 3/1994 | Gebs | |
| 5,718,345 | A * | 2/1998 | Hade, Jr. | B66C 13/12 212/349 |
| 5,928,032 | A | 7/1999 | Dreesen | |
| 6,170,607 | B1 * | 1/2001 | Freeman | B66C 15/065 182/18 |
| 6,325,749 | B1 * | 12/2001 | Inokuchi | B25J 5/06 182/2.11 |
| 7,090,086 | B2 * | 8/2006 | Dupre | B66C 13/12 212/350 |
| 7,708,592 | B2 | 5/2010 | Schnare | |
| 7,900,724 | B2 | 3/2011 | Promersberger et al. | |
| 9,791,071 | B2 * | 10/2017 | Ditty | F16L 3/015 |
| 2010/0206610 | A1 | 8/2010 | Yagi | |
| 2012/0217091 | A1 * | 8/2012 | Baillargeon | G08B 21/02 182/18 |
| 2013/0319792 | A1 * | 12/2013 | Christian | B66F 11/044 182/2.2 |
| 2013/0323965 | A1 | 12/2013 | Buenz | |
| 2015/0307337 | A1 * | 10/2015 | Ewert | B66F 11/046 182/2.4 |
| 2016/0049849 | A1 * | 2/2016 | Boger | H02K 7/1823 182/129 |
| 2018/0134533 | A1 * | 5/2018 | Ewert | B66C 23/702 |
| 2018/0164148 | A1 * | 6/2018 | Mueller | G01G 23/007 |

OTHER PUBLICATIONS

Kuseian, John, "Naval Power Systems Technology Development Roadmap PMS 320," Electric Ships Office PMS 320 Directing the Future of Ships Power, Apr. 2013.

Anderson, Michele, et al., "Special Notice 13-SN-0023, Special Program Announce for 2013 Office of Naval Research, Research Opportunity: Select Topics in Power Generation and Energy Storage," ONR Special Notice 13-SN-0023, Found at http://www.navsea.navy.mil/Media/Naval%20Power%20Systems%20Technology%20Development%20Roadmap%20-%20Distribution%20A%20-%2014%20May%202013%20-%20Final.pdf, 2013.

LaserMotive "Comparison of Optical Fiber to Copper Wire," found at http://lasermotive.com/wp-content/uploads/2012/12/Fiber_vs_Copper_summary2013Jan.pdf, Jan. 2013.

Terex, "Lean, Clean and Green," Hypower informational brochure, Apr. 2015.

* cited by examiner

ISOLATED ELECTRONIC BACKBONE ARCHITECTURE FOR AERIAL DEVICES

BACKGROUND

1. Field

Embodiments of the invention relate to power systems for aerial devices. More particularly, embodiments of the invention relate to an isolated electronic backbone architecture for aerial devices.

2. Related Art

Utility workers utilize an aerial device to reach inaccessible locations. The aerial device generally includes a boom with a utility platform connected to a distal end of the boom. One or more utility workers stand in the utility platform to perform a task. Utility workers typically use an aerial device to access overhead electric power lines and electric power components for installation, repair, or maintenance.

The utility platforms utilized by electric utility workers are highly insulated so as to prevent the discharge of electricity through the utility truck, and especially through the utility worker. However, these utility platforms require power to perform various functions and equipment. In order to maintain this insulation, aerial devices of the prior art utilize only hydraulic power or battery power at the utility platform. This presents several problems because hydraulic power is limited in what functions it can perform and is very inefficient, and battery power requires continual replacement and maintenance.

Aerial devices of the prior art are also frequently inefficient. First, the hydraulic power systems of aerial devices are powered by large diesel or gas internal-combustion engines. These engines must operate continuously or nearly continuously during static operations to power the various functions. While some operators can turn the engine off when not necessary, the ratio of hydraulic operation to total engine running time is very inefficient. Similarly, the entire engine must be run even when only a small percentage of the total horsepower is necessary to perform the various functions. Second, there are significant energy losses in valves, manifolds, and lines. For example, pressure drop from a pump to an actuator can be as great as 400 psi in some system designs.

SUMMARY

Embodiments of the invention solve the above-mentioned problems and provide a distinct advance in the art by providing an electronic backbone architecture that provides power on demand and provides electrical power throughout the aerial device. The electronic backbone architecture is a system of electrical components connected by an electrical line, all of which is electrically isolated from the aerial device. The electronic backbone architecture provides an electrical motor associated with a respective actuator. Power is provided to each electrical motor from a power source via a protected electrical line. Each electrical motor is only powered so long as the actuator is being utilized. This is different from the inefficient prior art in which a single, large hydraulic pump provides the power to all of the actuators and runs continuously or nearly continuously. As such, the excessive and unnecessary motor running is eliminated. The losses due to hydraulic lines and valves are also effectively reduced. Further, the excessive weight from hydraulic lines and fittings is reduced.

A first embodiment of the invention is directed to an electronic backbone architecture configured to provide electrical power to an aerial device. The isolated electronic backbone architecture comprises: a power source for generating electrical power, a first actuator, a first electrical motor for powering the first actuator, a second actuator, a second electrical motor for powering the second actuator, and a protected electrical line. The first actuator is disposed adjacent to the first electrical motor. The second actuator is disposed adjacent to the second electrical motor. The protected electrical line is configured to carry electrical current between the power source, the first electrical motor, and the second electrical motor.

A second embodiment of the invention is directed to an aerial device. The aerial device comprises a grounded base, an insulated utility platform assembly, and an isolated electronic backbone architecture. The insulated utility platform is disposed at a distal end of a boom assembly of the grounded base. The isolated electronic backbone architecture provides electrical power at the utility platform. The electronic backbone architecture comprises a power source and a protected electrical line. The protected electrical line traverses from the base to the utility platform. The protected electrical line provides electrical current at the utility platform and the grounded base while being isolated from both the insulated utility platform and the grounded base.

A third embodiment of the invention is directed to an aerial device. The aerial device comprises a grounded base, an insulated utility platform assembly, and an isolated electronic backbone architecture. The insulated utility platform is disposed at a distal end of a boom assembly of the grounded base. The isolated electronic backbone architecture provides electrical power at the utility platform. The electronic backbone architecture comprises a power source and a protected electrical line. The protected electrical line traverses from the base to the utility platform. The protected electrical line provides electrical current at the utility platform and the grounded base while being isolated from both the insulated utility platform and the grounded base.

Additional embodiments of the invention may be directed to a method of providing power to an aerial device, a method of insulating an aerial device, a method of providing electrical power at a utility platform, etc. Embodiments of the invention may also be directed to electrical motors configured for use with an electronic backbone architecture for an aerial device, actuators configured for use with an electronic backbone architecture, protected electrical lines configured for use with an electronic backbone architecture, etc.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
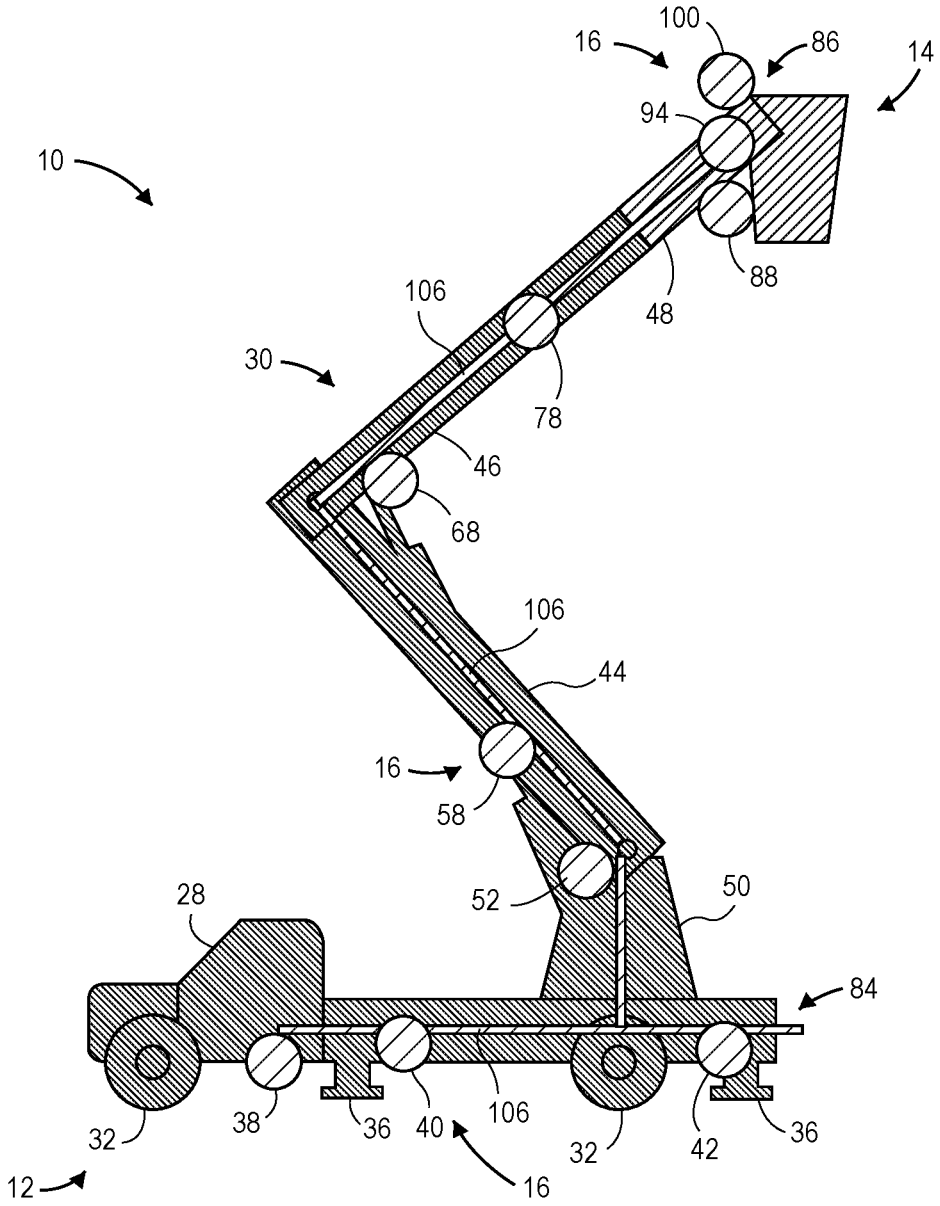
FIG. 1 is a schematic diagram of an aerial device with an electronic backbone architecture.

The drawing figures do not limit the invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment", "an embodiment", "embodiments", "various embodiments", "certain embodiments", "some embodiments", or "other embodiments" mean that the feature or features being referred to are included in at least one embodiment of the technology. Separate references to "one embodiment", "an embodiment", "embodiments", "various embodiments", "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Figure 2:
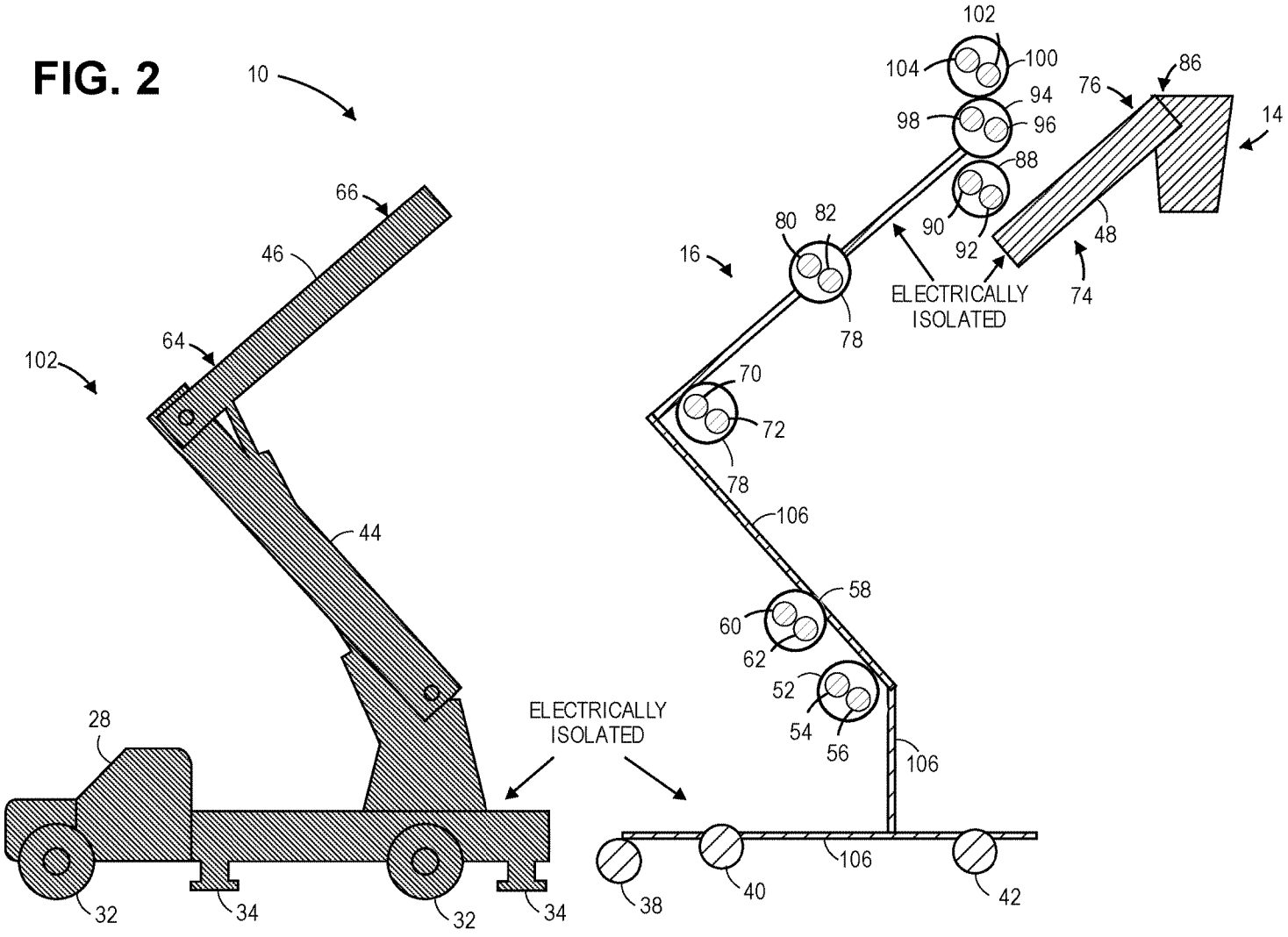
FIG. 2 is the schematic diagram of the aerial device, with a grounded base and an insulated utility platform separated from the electronic backbone architecture to demonstrate how each is electrically isolated from the other.

Turning now to the figures, and specifically FIG. 1, a schematic diagram of an aerial device 10 is provided. The aerial device 10 comprises a grounded base 12, an insulated utility platform 14, and an electronic backbone architecture 16. As discussed below, each of the grounded base 12, insulated utility platform 14, and the electronic backbone architecture 16 is electrically isolated from one another, as can be seen in FIG. 2. The grounded base 12 is in contact with the ground and formed at least in part of metal, such that electrical current could flow therethrough and discharge. The insulated utility platform 14 is formed at least in part of a polymer, such that electrical current is prevented from discharging to the grounded base 12. The electronic backbone architecture 16 provides power and mechanical movements to move the various components of the aerial device 10 as desired. The electronic backbone architecture 16 is formed at least in part of metal, such that electrical current can flow therethrough. However, the electronic backbone architecture 16 is electrically isolated from both the grounded base 12 and the insulated utility platform 14, such that any external application of current thereto would not be able to discharge through the grounded base 12. This allows the electronic backbone architecture to safely operate even within the insulated utility platform 14 in an environment in which contact with an electrified external source (such as a power line) is likely.

Figure 3:
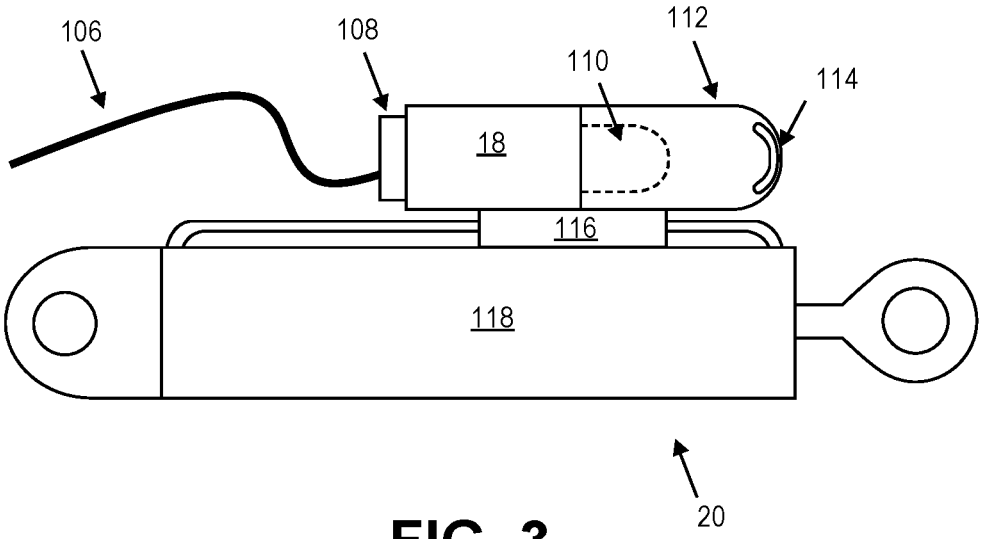
FIG. 3 is a schematic diagram of an electric motor and an associated linear actuator as a component of the electronic backbone architecture.
Figure 4:
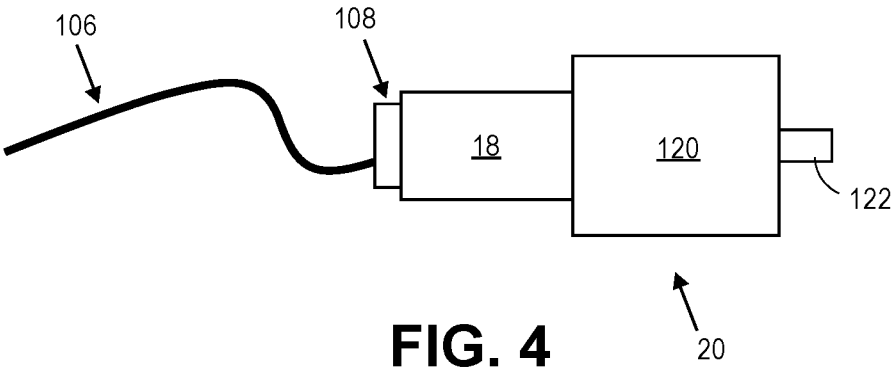
FIG. 4 is a schematic diagram of an electric motor and an associated rotary actuator as a component of the electronic backbone architecture.

The electronic backbone architecture 16 runs throughout the grounded base 12 and the insulated utility platform 14 to provide electrical power to various electrical motors 18, which in turn operate various actuators 20. The actuators 20 may include linear actuators 22 (that selectively elongate to achieve the desired motion of the component, as illustrated in FIG. 3) and rotary actuators 24 (that selectively rotate or pivot to achieve the desired motion of the component, as illustrated in FIG. 4). It should be appreciated that the electronic backbone architecture 16 is electrically isolated from both the grounded base 12 and the insulated utility platform assembly 14. In this way, a single failure of the insulation will not allow an undesirable and dangerous discharge of electricity through the grounded base 12. Each of the electrical motors 18 is located substantially adjacent to the associated actuator 20. The electrical motor runs only so long as is necessary to provide power to the actuator. This provides a highly efficient operation in moving the boom because only the necessary electrical motors are running at any given time.

Reference herein to "isolated," "electrically isolated," "insulated," "electrically insulated," or similar phraseology should be understood to mean prevention of the discharge or flow of electrical charge. These terms can refer to dielectric materials that have a high resistivity (such as a polymer or ceramic), physical separation (such that air is the insulator), or the like. The degree to which the various components are isolated may meet or exceed certain Occupational Safety and Health Administration (OSHA) regulations or other applicable safety regulations.

The grounded base 12 generally includes a chassis 26, a cab 28, and a boom assembly 30. The boom assembly 30 is rotatably mounted onto the chassis 26. The grounded base 12 of the aerial device 10 is a selectively stabilized platform. In embodiments of the invention, the base 12 is a utility truck (as illustrated in FIG. 1), a crane base, an oilrig, an earth-working machine, or a fixed structure. The base 12 provides stability and a counterweight to a load being supported by the boom assembly 30. The base 12 may be specifically grounded (e.g., via a grounding cable or the like) or it may be incidentally near enough to the ground to be considered grounded.

The base 12 typically is in contact with the ground via a set of tires 32, a set of front outriggers 34, and/or a set of rear outriggers 36. It should be appreciated that outriggers are typically formed of metal and as such are electrically conductive. The outriggers may fully or partially raise the tires 32 off the ground. The base 12 may also include a mobile operations motor that propels the grounded base 12 along the ground between work sites. The mobile operations motor is typically an internal combustion engine, but could be an electrical engine. The mobile operations engine is typically electrically isolated from the electronic backbone architecture 16. This is because the mobile operations engine is typically not in use while static operations are being performed. The mobile operations engine is in contact with the grounded base 12.

The base 12 includes various components of the electronic backbone architecture 16. In embodiments of the invention, the base 12 comprises a power source 38, a front outrigger assembly 40, and a rear outrigger assembly 42. The power source 38 generates the electrical power that will be utilized by the various electrical motors 18 discussed below. The power source 38 may additionally, or in the alternative, include a battery or other charge-storing component. It should be appreciated that, like other components of the electronic backbone architecture 16 described below, the power source 38 is electrically isolated from the other components of the grounded base 12. In this way, if during an accident a component of the electronic backbone architecture 16 becomes electrically stimulated, the power source 38 will not allow for a discharge of the electricity that could cause serious damage and potential injury to the utility worker. This is because the power source is surrounded by an insulating material such that an electrical charging of the power source 38 (such as by a component of the electronic backbone architecture 16 coming into contact with an external electrical power line) is prevented.

The front outrigger assembly 40 and the rear outrigger assembly 42 each comprises an electrical motor 18 and at least one actuator 20. Upon receipt of a command to deploy, the electrical motor 18 associated with the actuators 20 pushes or otherwise deploys the front outrigger assembly 40 and the rear outrigger assembly 42. Typically, the front outrigger assembly 40 and the rear outrigger assembly 42 will deploy simultaneously. However, in some instances, the utility worker may decide to deploy them independently (such as to ensure that either is properly set before attempting to deploy the other). It should be appreciated that the front outrigger assembly 40 comprises a left outrigger and a right outrigger. Similarly, the rear outrigger assembly 42 comprises a left outrigger and a right outrigger. Therefore, in embodiments of the invention, the front outrigger assembly 40 and the rear outrigger assembly 42 may include a single electric motor 18, a left actuator, and a right actuator.

In embodiments of the invention, the boom assembly 30 comprises a pivoting boom section 44, an outer boom section 46, and an inner boom section 48. The pivoting boom section 44 is secured to a boom turret 50 on the chassis 26. The boom assembly 30 pivots and/or rotates via various electrical motors 18 and actuators 20, as discussed below. The various components of the boom assembly 30 work together in order to place the utility platform assembly 14 (or other implement) in a desired position relative to the ground and any other object (such as a utility pole) such that the utility worker can perform the desired task. Typically, the grounded base 12 is stationary and secured (such as via the outriggers) while the boom assembly 30 is in operation.

The pivoting boom section 44 pivots upward and downward relative to the boom turret 50. The pivoting boom section 44 does not telescope out of any other boom section. Instead the pivoting boom section 44 rotates about the base 12 at the boom turret 50, and the outer boom section 46 pivots and/or rotates relative to the pivoting boom section 44. The use of the pivoting boom section 44 allows the utility platform 14 to reach certain areas and avoid obstacles in the working environment. The pivoting boom section 44 is typically formed of metal for structural stability.

In embodiments of the invention, a turret rotation assembly 52 is associated with the pivoting boom section 44 and the boom turret 50. A turret rotation motor 54 powers a turret rotation actuator 56. The turret rotation motor 54 receives electrical current from the power source 38. The turret rotation motor 54 powers the turret rotation actuator 56 that rotates the boom assembly 30 about a substantially vertical axis. The turret rotation motor 54 may also receive instructions indicative of movement in a certain direction at a certain speed, a desired total angle change, a desired direction, the speed of angle change, an ending angle, etc. The boom rotation motor may then power the turret rotation actuator 56 to achieve the desired angle. It should be appreciated that in some embodiments of the invention, the boom rotation motor is only engaged so long as the boom rotation actuator is being moved. In this way, excessive losses and idling from traditional configurations are avoided.

Similarly, embodiments of the invention include a turret pivot assembly 68 associated with the pivoting boom section 44 and the boom turret 50. A turret pivot actuator 60 is powered by a turret pivot motor 62 (which may be the same as, or distinct from, the turret rotation motor 54). The turret pivot motor 62 receives electrical current from the power source 38. The turret pivot motor 62 powers the turret pivot actuator 60 to pivot the boom assembly 30 upward and downward between substantially horizontal and substantially vertical). The boom pivot motor may power the turret pivot actuator 60 to achieve the desired vertical angle (i.e., angle above a horizontal plane). The turret pivot actuator 60 may be a linear actuator 22 (such as illustrated in FIG. 3 and discussed below) or a rotary actuator 24 (such as illustrated in FIG. 4 and discussed below).

The outer boom section 46 is a hollow, elongated member that presents a proximal end 64 and a distal end 66. The outer boom section 46 is rotatably and/or pivotably coupled to the pivoting boom section 44 at the proximal end 64 of the outer boom section 46. The outer boom section 46 is typically formed of a metal for structural stability, but could instead be formed of an electrically-resistant polymer, such as fiberglass or another material.

Embodiments of the invention include an outer-boom pivot assembly 68 associated with the pivoting boom section 44 and the outer boom section 46. An outer-boom pivot actuator 70 is disposed on the pivoting boom section 44 to push the outer boom section 46 to a specific angle relative to the pivoting boom section 44. The outer-boom pivot actuator 70 is powered by an outer-boom pivot motor 72. The outer-boom pivot motor 72 receives electrical current from the power source 38. The outer-boom pivot motor 72 powers the outer-boom pivot actuator 70 to pivot the outer boom section 46 upward and downward. The outer-boom pivot motor 72 may power the outer-boom pivot actuator 70 to achieve the desired vertical angle (i.e., angle above a horizontal plane).

The inner boom section 48 is at least partially disposed within the distal end 66 of the outer boom section 46 and telescopes to extend or retract relative to the first boom section. The inner boom section 48 is an elongated member that presents a proximal end 74 and a distal end 76. The inner boom section 48 is formed of an electrically-resistant polymer, such as fiberglass or another material. The proximal end 74 of the inner boom section 48 is disposed within the outer boom section 46. The distal end 76 of the inner boom section 48 is secured to the utility platform 14.

The inner boom section 48 is elongated and retracted within the outer boom section 46 via a boom elongation assembly 78. A boom elongation actuator 80 pushes or pulls the inner boom to achieve a desired length of the boom assembly 30. The boom elongation actuator 80 is powered by a boom elongation motor 82. The boom elongation motor 82 receives electrical current from the power source 38. The boom elongation motor 82 powers the boom elongation actuator 80 to elongate the boom assembly 30 or retract the boom assembly 30, as desired.

For purposes of this disclosure, the outer boom section 46 and the pivoting boom section 44 are considered components of the grounded base 12, and the inner boom section 48 is considered a component of the insulated utility platform assembly 14. This is best illustrated in FIG. 2. This is because, as discussed above, the base 12, the outer boom section 46, and the pivoting boom section 44 are all typically formed of a metal and are in contact with the grounded base 12 (such that an application of electrical current to the outer boom section 46 and/or the pivoting boom section 44 will discharge through the grounded base 12). Alternatively, the inner boom section 48 is isolated from the grounded base 12 via the insulative properties of the polymer (or other material) from which it is formed. In other embodiments of the invention, the entirety of the boom assembly 30 is formed of a polymer. In these embodiments, the entirety of the boom assembly 30 may be considered a component of the utility platform assembly 14. In either case, each of the three distinct components of the aerial device 10 (the grounded base 12, the utility platform 14, and the electronic backbone architecture 16) is electrically distinct and isolated from the others.

In other embodiments of the invention, the boom assembly 30 comprises a single boom section (not illustrated). In still other embodiments of the invention, the boom assembly 30 comprises the pivoting boom section 44, the outer boom section 46, a first inner boom section, and a second inner boom section that telescopes within the first inner boom section (not illustrated). The first inner boom section may be formed of a polymer as well, so as to increase the range of the insulated utility platform assembly 14.

The boom assembly 30 is extended, retracted, rotated, and pivoted via a set of lower boom controls 84. The set of lower boom controls 84 is disposed on or near the base 12. In embodiments of the invention, the set of lower boom controls 84 is disposed externally to the aerial device 10, such that an operator stands on the ground or an exterior platform to manipulate the set of lower boom controls 84. In other embodiments, the set of lower boom controls 84 is located in a cab 28 of the aerial device 10, such that the operator sits or stands in the cab 28 to manipulate the set of lower boom controls 84.

The set of lower boom controls 84 sends commands and/or power to the various electric motors 18, which in turn power various actuators 20 to manipulate the boom assembly 30 or utility platform 14 to move in a desired direction. In embodiments of the invention, the set of lower boom controls 84 comprises a joystick (not illustrated) in which the movement of the joystick is translated into electrical motor 18 operations with the assistance of a power source 38, inputs into a computer which directs the electrical motor 18 operations, or any combination thereof.

The insulated utility platform assembly 14 is disposed on the boom assembly 30 to provide an elevated platform for the accomplishment of a task by a utility worker. The insulated utility platform 14 generally includes the inner boom section 48 and a utility platform 14 (both formed of a polymer). The utility platform 14 is a bucket or other platform that couples to the distal end of the inner boom section 48. In embodiments of the invention, the utility platform 14 comprises four bucket sidewalls and a bucket floor that form a cavity and present an interior segment and an exterior segment. The operator stands in the cavity to perform work. The platform may further comprise a bucket lip. There may be enough space within the platform for the operator to walk around, as well as store tools or supplies. The utility platform 14 may further comprise a door in at least one of the bucket sidewalls to allow for ingress and egress of the operator. In other embodiments of the invention, the utility platform 14 is a basket that comprises a handrail and a kick plate (not illustrated).

The four bucket sidewalls of the utility platform 14 may be successively coupled to one another to form the interior segment with a horizontal cross-section that is substantially rectangular. Thus, two of the opposing bucket sidewalls may have a greater width than the other two opposing bucket sidewalls. In other embodiments, the four bucket sidewalls may form the interior segment with a horizontal cross-section that is substantially square. The bucket floor is coupled to at least one of the four bucket sidewalls. In embodiments of the invention, the bucket lip is coupled to at least one of the four bucket sidewalls. Although the dimensions of the platform may vary widely, an exemplary platform for one operator has a horizontal cross-section of approximately 24 inches by approximately 30 inches and has a height of approximately 42 inches. An exemplary platform for two operators has a horizontal cross-section of approximately 24 inches by approximately inches and has a height of approximately 42 inches.

A set of upper boom controls 86 allows the operator to move the boom assembly 30 from within the utility platform 14. The operator in the bucket has a better vantage point to know where and how to position the boom assembly 30 as opposed to the operator on the ground. Additionally, the set of upper boom controls 86 promotes efficiency by allowing the operator to directly control the movement of the boom assembly 30. In embodiments of the invention, an assistant operator (not illustrated) can access the lower boom controls 84 for the duration of the operator being in the utility platform 14. This provides a safety backup to allow the assistant operator to remove the operator from a dangerous situation should the operator become incapacitated or there be a failure in the set of upper boom controls 86. The set of upper boom controls 86 may utilize the same or a different mechanism from the set of lower boom controls 84.

The set of upper boom controls 86 comprises a dash cover and at least one input (not illustrated). In various embodiments of the invention, the input can be a valve handle, a joystick, a button, a switch, or a combination thereof. The dash cover is generally flat or arcuate and presents at least one opening. Each of the at least one opening is situated around each of the at least one input. The dash cover may additionally contain written instructions and safety information.

In embodiments of the invention, the utility platform 14 remains substantially level regardless of the position of the boom assembly 30 via a platform leveling assembly 88. The utility platform 14 is leveled by a platform leveling assembly. The platform leveling assembly keeps the floor of the utility platform 14 substantially parallel to the ground. This is important especially during movement of the boom assembly 30 with the utility worker disposed in the utility platform 14. Sudden changes in the relative angles of the utility platform 14 can be dangerous for the utility worker. In other embodiments, the operator manipulates a set of upper controls, discussed below, to manipulate the utility platform 14 into the flat position. The platform leveling assembly comprises a platform leveling motor 90 that powers at least one platform leveling actuator 92. The platform leveling motor 90 either detects or acquires an indication of the angle of the utility platform 14 with respect to a hypothetical horizontal plane. The platform leveling motor 90 then automatically moves the utility platform 14 to keep the utility platform 14 level, especially during movement of the utility platform 14.

In embodiments of the invention, the implement can be maneuvered relative to the inner boom section 48 via a platform control assembly 94. The platform control assembly 94 comprises at least one platform control actuator 96 and at least one platform control motor 98. The platform control assembly 94 allows the utility worker to position the utility platform 14 in a desired orientation relative to the inner boom assembly 30. This allows the utility worker to reach a desired position so as to complete the task. This may allow the utility platform 14 to pivot about the end of the inner boom section 48, extend or retract, etc.

In embodiments of the invention, a jib, winch, or other implement is powered by an implement control assembly 100 disposed in or near the utility platform assembly 14. The implement assists the utility worker with performing the various tasks. For example, the jib may allow the utility worker to move an orient an object such as a repair part. As another example, the winch may allow the utility worker to lift a heavy object. The implement could also provide power for various external tools that could be utilized by the utility worker. The implement may comprise an implement actuator 102 and an implement motor 104.

FIG. 3 depicts a schematic diagram of an exemplary linear actuator 22 and associated electric motor 18. The linear actuator 22 elongates a component of the aerial device 10. This elongation may make the elongating component longer or may pivot the elongating component relative to another component. For example, the turret pivot actuator 70 may elongate so as to push or pull the pivoting boom segment relative to the boom turret 50. The elongating component could be any of the above-discussed actuators 20 or other components of the aerial device 10.

As seen in FIG. 3, the electronic motor 18 and associated linear actuator 22 comprises a cable 106, a motor controller 108, the electric motor 18, a pump 110, a reservoir 112, a diaphragm 114, a manifold 116, and a hydraulic cylinder 118. The electronic motor 18 and associated linear actuator 22 operate as a standard hydraulic cylinder. The cable brings power and/or commands to the motor controller. The motor controller powers the motor 18 so as to the power the actuators 20.

FIG. 4 depicts a schematic diagram of an exemplary rotary actuator 24 and associated electric motor 18. The rotary actuator 24 rotates or pivots a component of the aerial device 10. This rotation or pivoting changes the position of the pivoting/rotating component relative to another component of the aerial device 10. For example, the turret pivot actuator 70 may elongate so as to push or pull the pivoting boom segment relative to the boom turret 50.

As seen in FIG. 4, the electronic motor 18 and associated linear actuator 22 comprises the power cable, the motor controller, the electric motor 18, a gearbox 120, and an output shaft 122. The gearbox provides rotation that is appropriate for the amount of power provided and can shift to another gear to assist in the rotation. The output shaft is secured to, or otherwise associated with, the component that is intended to be moved.

Figure 5:
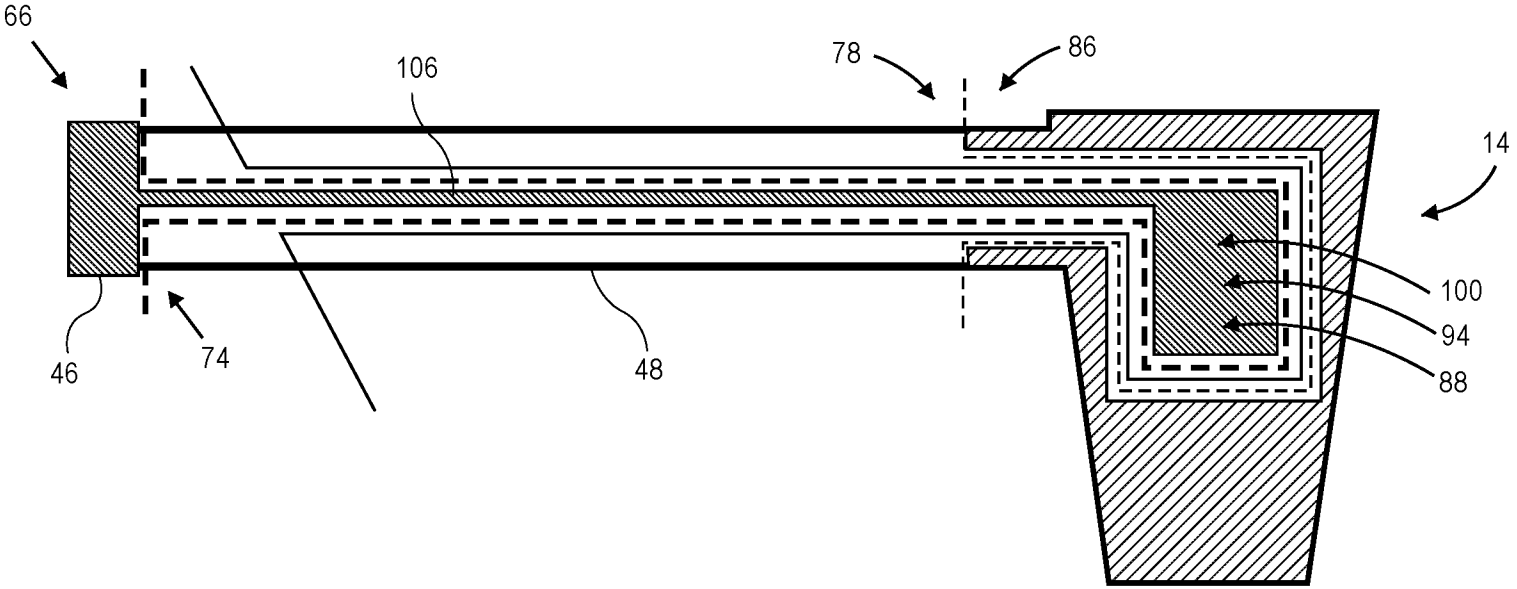
FIG. 5 is a schematic diagram demonstrating how the electronic backbone architecture is isolated from the insulated utility platform.

FIG. 5 depicts a schematic of the utility platform 14, illustrating how the components of the electronic backbone architecture 16 (specifically, the platform leveling assembly 88, the platform control assembly 94, and the implement control assembly 100) are brought into the utility platform 14, while preventing a dangerous discharge of electricity. The discharge is prevented by shielding the electrical components, such as the cable 106. The cable 106 may be embedded in the inner boom section 48 and the utility platform 14, such as by laying the cable 106 into the fiberglass or other polymer of the inner boom section 48 and the utility platform 14 during construction. This provides further insulation and prevents damage to the cable. The electrical components of the electronic backbone architecture 16 are also not grounded such that any incidental contact with an electrified source would not allow for a discharge. In this way, the electronic backbone architecture 16 is safe to use even around electrical lines and the like.

Figure 6:
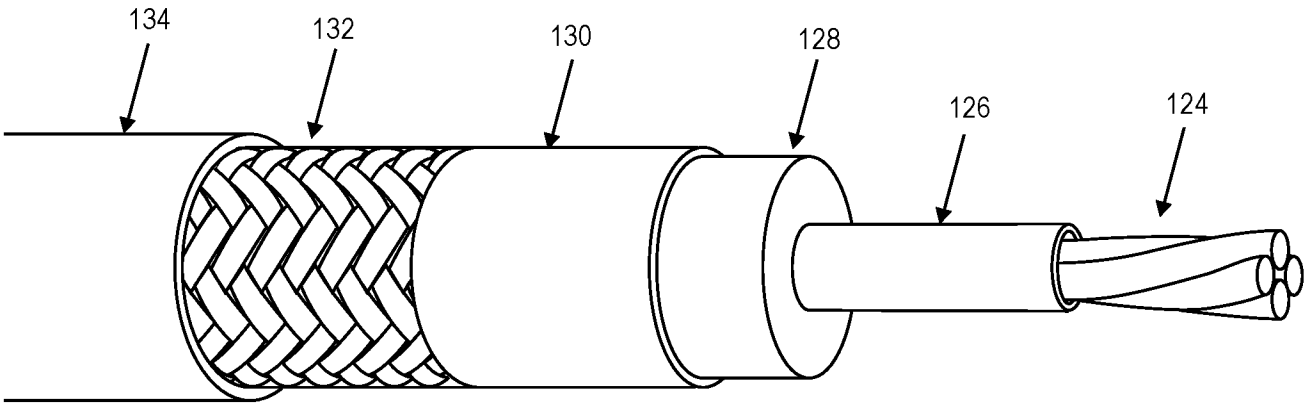
FIG. 6 is a cut view of an exemplary electrical cable for use with the electronic backbone architecture.

FIG. 6 depicts an exemplary electrical cable (which, in some embodiments, is cable 106) for carrying the current associated with the electronic backbone architecture 16 throughout the aerial device 10. As discussed above, the electrical cable of the electronic backbone architecture 16 keeps the electronic backbone architecture 16 electrically isolated from both the grounded base 12 and the insulated utility platform assembly 14. The electrical cable includes various layers to allow the electrical cable to be disposed adjacent to very high power electrical lines and the like without receiving interference, discharging that electrical current, or the like. The electrical cable includes metallic current-carrying wires 124, an inner protective casing layer 126, a high-voltage insulation layer 128, a magnetic field shielding layer 130, an electric field shielding layer 132, and an outer protective casing layer 134.

In embodiments of the invention, potential energy from lowering the boom assembly 30 (or other component) can be recouped. The recouped energy is accumulated in an energy storage device momentarily. The recouped energy can then used for future machine operations. This is advantageous over prior art aerial devices in which such energy was lost to heat and friction.

While it has been discussed throughout, the steps of a method for performing a job or task while utilizing an aerial device 10 powered by an electronic backbone architecture 16 will now be discussed. The operator operates the set of upper boom controls 86 (which instruct the various electric motors 18 to activate and move their associated actuators 20 as desired) to position the utility platform 14 from a starting position adjacent to the ground into an elevated, desired location or orientation. The operator then performs a job or task while standing in the utility platform 14. The job or task could include, but is not limited to, installing equipment, repairing equipment, uninstalling equipment, testing equipment, clearing a power line, maintaining trees and other vegetation, installing utility poles, moving a load, rescuing a stranded person, extinguishing a fire, recording a video, taking a photograph, and observing or supervising a task or job performed by others. The utility worker may then perform additional jobs or tasks, which may include moving the utility platform 14 into a different location or orientation, using the set of upper boom controls 86 to instruct the various electric motors 18 to power their associated actuators 20. Upon the completion of all tasks or jobs, the utility worker returns the utility platform 14 to the position adjacent to the ground via the set of upper boom controls 86. It should also be noted that the assistant operator at the set of lower boom controls 84 could perform some or all of the movement of the utility platform 14.

Although the invention has been described with reference to the embodiments illustrated in the attached drawing figures, it is noted that equivalents may be employed and substitutions made herein without departing from the scope of the invention as recited in the claims.

Having thus described various embodiments of the inven-tion, what is claimed as new and desired to be protected by Letters Patent includes the following:

1. An aerial device comprising:

a grounded base;

an insulated utility platform disposed at a distal end of a boom assembly;

an isolated electronic backbone architecture for providing electrical power at the utility platform, said electronic backbone architecture comprising— a power source for generating electrical power;

a first actuator;

a first electrical motor for powering the first actuator, wherein the first actuator is disposed adjacent to the first electrical motor;

a second actuator;

a second electrical motor for powering the second actuator, wherein the second actuator is disposed adjacent to the second electrical motor;

at least one protected electrical cable that traverses from the base to the utility platform, wherein the protected electrical cable provides electrical current to electrical components at the utility platform and the grounded base while being electrically isolated from both the insulated utility platform and the grounded base; and wherein the first and second electrical motors are associated with the insulated utility platform and electrically isolated from the utility platform and the grounded base.

2. The aerial device of claim 1, wherein the grounded base is electrically isolated from both the electronic backbone architecture and the insulated utility platform, wherein the electronic backbone architecture is electrically isolated from both the grounded base and the insulated utility platform, wherein the insulated utility platform is electrically isolated from both the grounded base and the electronic backbone architecture.

3. The aerial device of claim 2, wherein an incidental contact at the insulated utility platform with an electrified source would be prevented from discharging through the grounded base.

4. The aerial device of claim 1, wherein the first actuator is a linear actuator, wherein the second actuator is a rotary actuator.

5. The aerial device of claim 4, wherein the first actuator is disposed on the aerial device and secured such that an elongation of the first actuator corresponds to an elongation or pivoting of a component of the aerial device, wherein the second actuator is disposed on the aerial device and secured such that a rotation of the second actuator corresponds to a rotation of a component of the aerial device.

6. The aerial device of claim 5, wherein the first motor supplies power to the first actuator only so long as the elongation or pivoting is desired, wherein the second motor supplies power to the second actuator only so long as the rotation is desired, wherein each said desire is respectively indicated by by an input by a utility worker into a set of controls.

7. The aerial device of claim 1, wherein the insulated utility platform further comprises:

a platform level assembly, and a platform control assembly, wherein the platform level assembly and the platform control assembly are actuated by the first electrical motor.

8. The aerial device of claim 1, wherein the protected electrical cable is resistive to particular voltage levels, electrical fields, and magnetic fields.

* * * * *